United States Patent [19]

Carson, Jr. et al.

[11] 4,333,398

[45] Jun. 8, 1982

[54] DRIVING FORCE CONTROL SYSTEM FOR IMPACT PRINTER

[75] Inventors: Andrew B. Carson, Jr.; Samuel C. Harris, Jr., both of Waynesboro, Va.

[73] Assignee: General Electric Company, Waynesboro, Va.

[21] Appl. No.: 204,632

[22] Filed: Nov. 6, 1980

[51] Int. Cl.[3] ..... B41J 7/84; B41J 7/92; B41J 9/38; B41J 9/42

[52] U.S. Cl. ..... 101/93.02; 101/93.03; 400/166; 400/167

[58] Field of Search ..... 361/152, 153, 154; 101/93.02, 93.03; 400/121, 157.2, 157.3, 166, 167

[56] References Cited

U.S. PATENT DOCUMENTS

| | | | |
|---|---|---|---|
| 3,678,847 | 6/1970 | Pear et al. | 101/93.02 |
| 4,162,131 | 7/1979 | Carson et al. | 400/124 |
| 4,192,230 | 3/1980 | Blom et al. | 101/93.03 |
| 4,291,992 | 9/1981 | Barr et al. | 400/124 |

*Primary Examiner*—Paul T. Sewell
*Attorney, Agent, or Firm*—Michael Masnik

[57] ABSTRACT

In a drive circuit for an electromagnetic printing element of a matrix impact printer, a drive pulse drives the printing element from the backstop toward a record medium to print indicia, and a damping pulse, applied to the printing element after its return to the backstop, urges it toward the backstop to limit rebound therefrom. Logical control circuitry is responsive to overlap of a drive pulse with a preceding damping pulse for terminating the damping pulse and for decreasing the width of the drive pulse in proportion to the amount of overlap. Blanking means are provided to prevent application of a damping pulse to the printing element until after the completion of a preceding drive pulse and after impact of the printing element with the record medium and with the backstop.

13 Claims, 4 Drawing Figures

LONG INTERVAL

SHORT INTERVAL

DRIVING FORCE CONTROL SYSTEM FOR IMPACT PRINTER

BACKGROUND OF THE INVENTION

The present invention relates to the control of the printing elements of impact printers such as dot matrix printers operating at very high data rates. In particular, the invention relates to control of the driving force applied to the printing element.

This invention applies to printers which develop a force whose direction is a function of the direction of the driving pulse. Generally, these include a plurality of printing elements, each having a moving electromagnetic coil operating in a fixed magnetic field, having attached thereto a print wire or stylus, the styli being arranged in spaced-apart relationship in a print head. One such print head is disclosed in U.S. Pat. No. 4,129,390, granted to J. E. Bigelow et al on Dec. 12, 1978, and comprises a stacked array of flat blade type printing elements.

Each printing element or blade is normally biased against a backstop and has associated therewith a drive circuit for controlling the operation thereof. The drive circuit applies a drive pulse to the printing element for moving it toward a record medium for printing indicia, the printing element then returning to the backstop. In order to minimize rebound of the printing element from the backstop, a damping pulse of reversed current may be applied to the printing element. In copending Application U.S. Ser. No. 204,628, filed concurrently herewith, by W. A. Hanger and A. B. Carson, entitled "BOUNCE CONTROL SYSTEM FOR IMPACT PRINTER", and assigned to the assignee of the present invention, there is disclosed a circuit for applying such a damping pulse to the printing element in response to impact of the printing element on the backstop, the damping pulse having a polarity opposite to that of the drive pulse. In that system, if a drive pulse overlaps in time with a preceding damping pulse, the two are simply additively supplied to the printing element, effectively cancelling each other out in the region of overlap.

A fundamental problem encountered in impact printers is the variation in printing rates. Because the timing between dots varies, the initial printing element momentum is not constant. This is because at high print rates it is necessary to apply a drive pulse to the blade before the kinetic energy for printing the preceding dot has been fully dissipated. It is, therefore, desirable to provide a variable period or current for the drive pulse to compensate for the differences in printing element starting momentum in order to achieve uniformity of print intensity.

U.S. Pat. No. 4,162,131, issued to A. B. Carson, Jr. et al on July 24, 1979, discloses means for modulating the amplitude or width of the drive pulse as a function of the time interval between successive drive pulses. But that system does not utilize damping pulses and, therefore, cannot take account of the effect of damping pulses on the overall energy supplied to the printing element.

SUMMARY OF THE INVENTION

The present invention relates to an improved drive circuit for the printing element of a high speed impact printer which overcomes disadvantages of prior systems while affording additional operational advantages.

It is a general object of this invention to provide a drive circuit for a matrix printer which effectively controls the bounce of the printing element from the backstop, while at the same time providing effective modulation of the drive pulse to achieve substantially uniform print intensity at varying print rates.

In connection with the foregoing object, it is another object of this invention to provide a system of the type set forth, which effectively minimizes the energy consumed by the system at high print rates.

More specifically, it is an object of this invention to provide a drive circuit of the type set forth which effects time duration modulation of the drive pulse in proportion to the amount of overlap of the drive pulse with the preceding damping pulses at high print rates.

These and other objects of the invention are attained by providing in an impact printer having a movable electromagnetic printing element biased toward a backstop, drive means for applying drive pulses to the printing element to move it from the backstop toward a record medium to print indicia and damping means for applying a damping pulse to the printing element after its return to the backstop from the record medium to minimize bounce of the printing element from the backstop, the improvement comprising: control means coupled to the drive means and to the damping means and responsive to the beginning of a drive pulse prior to the completion of the preceding damping pulse for varying the energy content of the drive pulse in proportion to the amount of overlap of the drive pulse with the preceding damping pulse.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the invention.

DESCRIPTION OF THE PREFERRED EMBODIMENT

Figure 1:
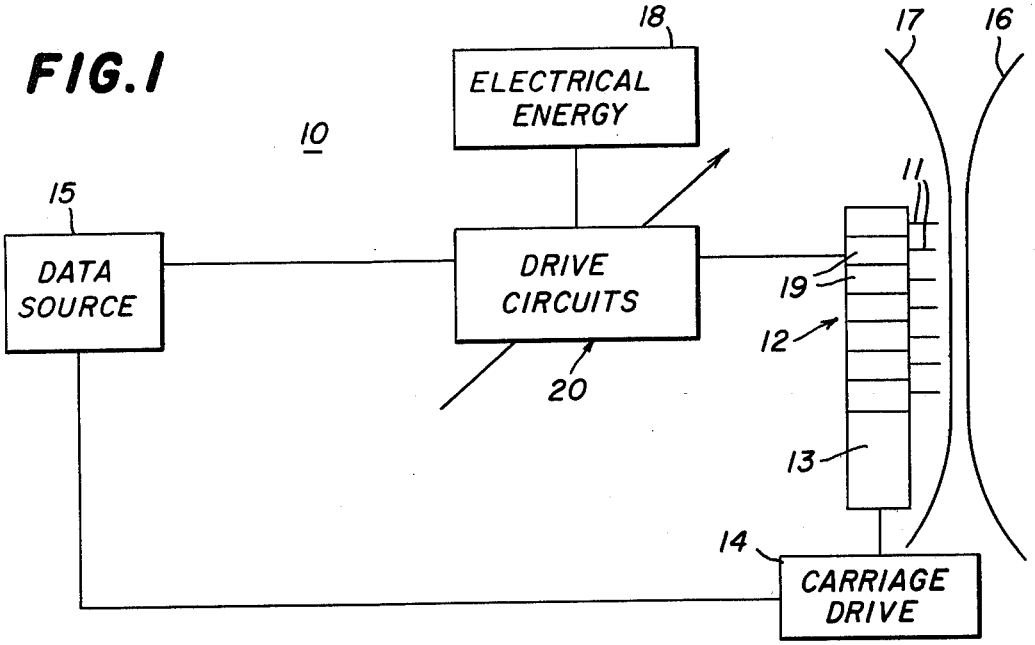
FIG. 1 schematically illustrates a high speed matrix printer incorporating printing element drive circuits constructed in accordance with and embodying the features of the present invention.

Referring to FIG. 1, there is schematically illustrated a dot matrix printer, generally designated by the numeral 10, which includes a plurality of print wires or styli 11 arranged in a vertical line. These styli 11 are maintained in a spaced-apart arrangement in a print head 12. The print head 12 is supported on a carriage 13 which is in turn driven by a carriage drive 14. Data from a data source 15 controls the carriage drive 14 for moving the carriage 13 across a line on a record medium 16, such as paper, in both directions in front of an ink ribbon 17. The data source 15 also provides input pulses defining the symbols to be printed for successive column positions of the carriage 13 during its movement across the record medium 16.

Connected to the data source 15 and to a source 18 of electrical energy is an assembly of drive circuits, generally designated by the numeral 20, for driving the printing blades 19 of the print head 12. Each stylus 11 is mounted on a separate printing blade 19, which includes an electromagnetic coil 19*a* (see FIG. 2) and is movable between a backstop (not shown) against which it is normally biased and the record medium 16. There is a separate drive circuit 20 for each printing blade 19 for selectively applying thereto drive pulses for driving the printing blades 19 toward the record medium 16 for printing indicia thereon.

Figure 2:
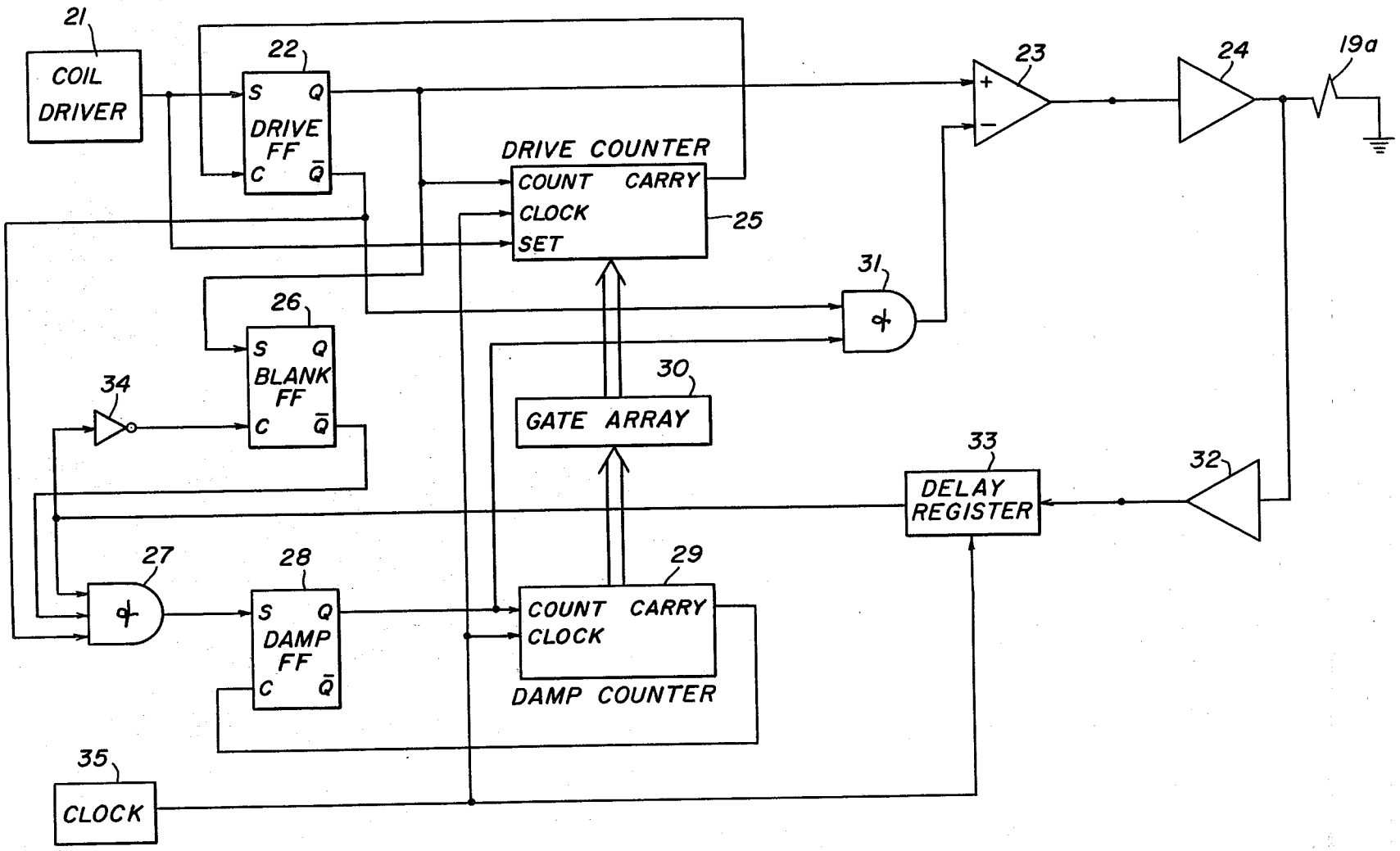
FIG. 2 is a schematic circuit diagram of the printing element drive circuit of the present invention.

Referring now to FIG. 2 of the drawings, each drive circuit 20 includes a coil driver 21 which produces pulses in response to the input pulses from the data source 15 and applies them to the set terminal of a drive flip-flop 22, the Q terminal of which is connected to the noninverting input terminal of an output buffer 23, the output of which is connected to the associated printing blade coil 19 through a drive amplifier 24. The Q terminal of the drive flip-flop 22 is also connected to the count input terminal of a drive counter 25, the set terminal of which is connected to the output of the coil driver 21 and the carry output terminal of which is connected to the clear terminal of the drive flip-flop 22.

The Q terminal of the drive flip-flop 22 is also connected to the set terminal of a blank flip-flop 26, the $\overline{Q}$ terminal of which is connected to one of the three input terminals of an AND gate 27, the output of which is connected to the set input terminal of a damp flip-flop 28. The Q terminal of the damp flip-flop 28 is connected to the count input terminal of a damp counter 29, the carry output terminal of which is connected to the clear terminal of the damp flip-flop 28. The damp counter 29 is also coupled through a gate array 30 to the drive counter 25 for determining the count at which the carry signal thereof will be generated, in a manner to be explained more fully below.

The $\overline{Q}$ terminal of the drive flip-flop 22 is connected to another of the input terminals of the AND gate 27 and to one of the two input terminals of an AND gate 31, the output of which is connected to the inverting input terminal of the output buffer 23. The other input terminal of the AND gate 31 is connected to the Q terminal of the damp flip-flop 28.

The input terminal of the printing blade coil 19*a* is also connected to the input of a sense amplifier 32, the output of which is connected to the input of a delay register 33. The output of the delay register 33 is connected to the third input terminal of the AND gate 27 and, through an inverter 34, to the clear terminal of the blank flip-flop 26. A crystal controlled system clock 35 provides the necessary precision time base to the drive counter 25, the damp counter 29 and the delay register 33.

Referring now to voltage wave form across the coil 19*a*, illustrated in FIG. 3 of the drawings, the operation of the drive circuit 20 will be described in detail. A pulse signal from the coil driver 21 sets the drive flip-flop 22 and also sets the drive counter 25 to a count value determined by the gate array 30 and the state of the damp counter 29. More particularly, the gate array 30 comprises an assembly of logic gates so arranged as to make the count period of the drive counter 25 approximate the value $T_D$ in accordance with the formula:

$$T_D = 0.4T_S + 0.6T$$

where $T_D$ is the time duration of the drive pulse to be applied to the printing blade 19, $T_S$ is the elapsed time of the damping pulse as determined by the count condition of the damp counter 29, and T is the maximum time duration of the drive pulse. For simplicity of explanation, the damping pulse will also be assumed to have a maximum time duration equal to T, although it will be appreciated that this need not be the case.

Figure 3:
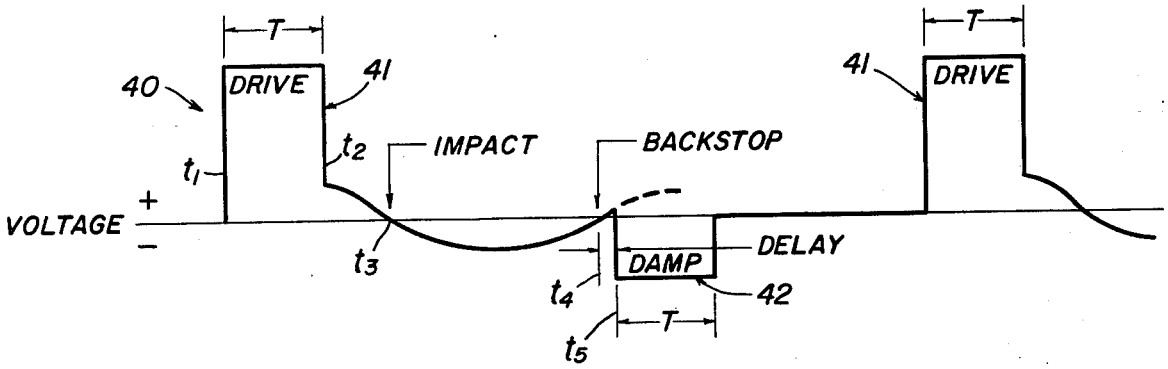
FIG. 3 is a wave form diagram illustrating the voltage across the printing element coil at relatively low print rates.

The drive flip-flop 22 serves as a source of drive pulses and, when set, produces at its Q output terminal a drive pulse, generally indicated by the reference numeral 41 in FIG. 3, which is applied to the noninverting terminal of the output buffer 23, which produces a positive pulse applied through the drive amplifier 24 to the printing blade coil 19*a* for driving it from the backstop toward the record medium for printing indicia.

The drive pulse from the Q terminal of the drive flip-flop 22 is also applied to the count terminal of the drive counter 25 for initiating its count sequence, which will continue until the predetermined count set therein is reached, at which time a signal will be generated at the carry output terminal for clearing the drive flip-flop 22 and terminating the drive pulse at the Q terminal thereof. Thus, the drive pulse 41 begins at time $t_1$ and continues until the count set in the drive counter 25 is reached, terminating at time $t_2$.

In the event of relatively low print rate, wherein the printing blade 19 comes completely to rest on the backstop between drive pulses, the drive pulse 41 will have its maximum width or duration T. Because the coil 19*a* is moving in a magnetic field, it generates a back emf which is proportional to its velocity and which has a polarity which reverses with the direction of motion of the printing blade 19. It will be appreciated that this back emf is increasing during the acceleration of the printing blade 19 by the drive pulse. Thus, the pulse 41 illustrated in FIG. 3, which represents the complete voltage across the coil 19, would actually have a sloping top but has, for simplicity, been illustrated as flat. After the termination of the drive pulse 41 at time $t_2$, the printing blade 19 continues to coast toward the record medium 16 until it impacts thereon at time $t_3$. During this coasting time, the only voltage across the coil 19*a* is the back emf generated thereby, which decreases to zero at the moment when the movement of the printing blade 19 stops on the record medium.

When the printing blade 19 rebounds from the record medium 16 and returns, under the urging of its bias means, to the backstop, the back emf generated in the coil 19*a* reverses polarity and gradually increases to a maximum and then decreases to zero when the printing blade motion stops at the backstop, at time $T_4$. Normally, the printing blade 19 will have a tendency to rebound from the backstop back toward the record medium, during which rebound the back emf of the coil 19*a* would again increase in a positive direction from time $t_4$.

These changes of polarity of the voltage across the coil 19*a* are sensed by the sense amplifier 32, which converts the coil voltage polarity to a logic signal which is applied through the delay register 33 to the inverter 34 and the AND gate 27.

The Q output of the drive flip-flop 22 also sets the blank flip-flop 26 for preventing an output at the $\overline{Q}$ terminal thereof. When the drive flip-flop 22 is cleared, it produces a $\overline{Q}$ output signal which is applied to the AND gate 31 and to the AND gate 27. At the same time, the set signal is removed from the blank flip-flop 26.

When the back emf of coil 19*a* goes negative at time $t_3$ as the printing blade 19 impacts on the backstop, the sense signals from the sense amplifier 32 and delay register 33 also go negative, this negative signal being inverted by the inverter 34 to clear the blank flip-flop 26, which in turn produces a Q output signal which is applied to the AND gate 27, which Q signal will continue until the blank flip-flop 26 is reset. When the back emf of the coil 19*a* again goes positive at time $t_4$ as the printing blade 19 rebounds from the backstop, the output signal from the sense amplifier 32 and delay register 33 also goes positive and is applied to the AND gate 27. Since the condition of the AND gate 27 is now permissive, it produces an output signal which sets the damp flip-flop 28, which in turn produces a Q output signal which is applied both to AND gate 31 and to the input terminal of damp counter 29 to control the count sequence thereof. Thus, the damp flip-flop 28 provides a damping pulse of controlled duration.

The application of the Q signal from the damp flip-flop 28 to the AND gate 31 simultaneously with the $\overline{Q}$ signal from the drive flip-flop 22 causes an output damping pulse from the AND gate 31 which is applied to the inverting input terminal of the output buffer 23, which changes the polarity of the damping pulse and applies it through the drive amplifier 24 to the coil 19*a* at time $t_5$. This negative pulse is generally designated by the numeral 42 in FIG. 3, the delay from time $t_4$ to time $t_5$ being created by the delay register 33. The negative-going damping pulse 42 immediately drives the voltage across the coil 19*a* back below zero, thereby causing the output of the sense amplifier 32 and the delay register 33 to go negative and terminating the output of the AND gate 27.

The damp counter 29 continues to count to a predetermined count value equal to the maximum time duration T of the damping pulse 42, at which time the damp counter 29 produces an output signal at its carry terminal for clearing the damp flip-flop 28 and terminating the Q output signal therefrom. This terminates the output from the AND gate 31, thereby terminating the damping pulse 42. It will be appreciated that the damping pulse 42 opposes the rebound motion of the printing blade 19 from the backstop and, therefore, at the conclusion of the damping pulse 42, the printing blade 19 should have come to rest on the backstop, where it awaits the next drive pulse 41.

Figure 4:
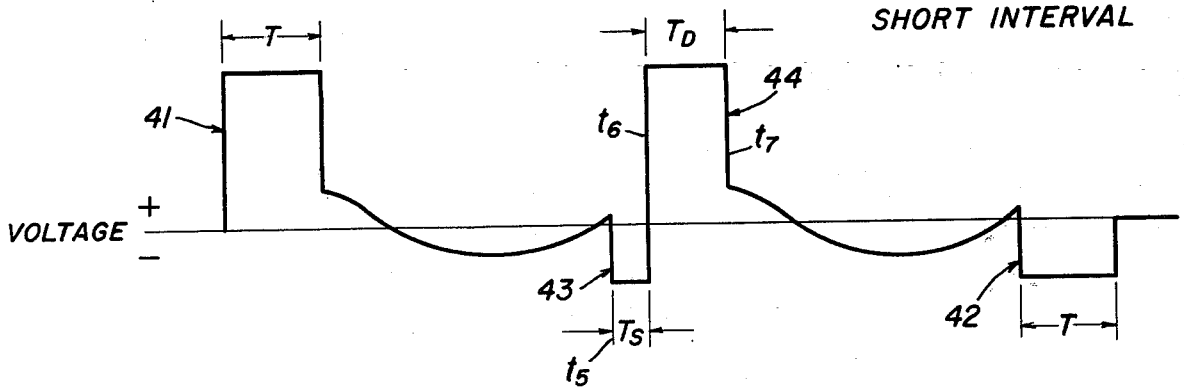
FIG. 4 is a wave form diagram similar to FIG. 3, illustrating the voltage across the printing element coil at high print rates.

Referring to FIG. 4, the operation of the system in the event of high print rates is similar, with the exception that because of the shortened interval between drive pulses, a drive pulse may overlap in time with a preceding damping pulse. Thus, the operation of the drive circuit 20 is identical with the described above until the initiation of the damping pulse 43 at time $t_5$. As the damp counter 29 undergoes its count sequence, the count thereof operates through the gate array 30 for continually changing the predetermined count at which the drive counter 25 will produce its carry output signal. More specifically, that predetermined count is initially set at a value corresponding to a time duration 0.6T, and with each count of the damp counter 29, that predetermined count of the drive counter 25 increases toward a maximum count corresponding to a time duration T when the damp counter 29 completes its count sequence.

Thus, if at time $t_6$ prior to the completion of the damping pulse 43 a drive pulse 44 begins, the drive counter 25 is set by the pulse from the coil driver 21 to a predetermined count corresponding to a time duration $T_D$ for the drive pulse which is proportional to the elapsed time $T_S$ of the damping pulse 43, the time duration $T_D$ being less than the maximum time duration T by an amount determined by the formula referred to above. In general, it can be seen that the shorter the elapsed time of the damping pulse 43 at the initiation of the drive pulse 44, i.e., the greater the overlap between the drive pulse 44 and the damping pulse 43, the shorter will be the duration $T_D$ of the drive pulse 44.

The setting of the drive flip-flop 22 at the beginning of the drive pulse 44 removes the $\overline{Q}$ output, thereby terminating the damping pulse 43 at the output of the AND gate 31 at time $t_6$. The drive pulse 44 will continue for a time duration $T_D$ at which time the new predetermined count set in the drive counter 25 will be reached and it will produce a signal at its carry terminal for clearing the drive flip-flop 22 and terminating the Q output therefrom at time $t_7$. The damp counter 29 will continue its count sequence to completion, at which time the damp flip-flop 28 will be cleared as described above.

It is a significant feature of the present invention that because the damping pulse is terminated by an over-lapping drive pulse at high print rates, and the overlapping drive pulse is shortened to a length which is proportional to the shortened damping pulse, the total energy applied to the printing blade 19 at high print rates is significantly reduced. Also, the modulation of the time duration of the drive pulse effectively serves to produce a substantially constant and uniform print intensity. Thus, the more rebound kinetic energy which remains in the printing blade 19 as a result of shortening of the damping pulse, the less drive pulse energy need be applied thereto, wherefore the present invention correspondingly decreases the time duration of the drive pulse.

It is another aspect of this invention that the drive flip-flop 22 cooperates with the AND gate 27 to prevent generation of a damping pulse until after the completion of the preceding drive pulse. Similarly, the drive flip-flop 22 cooperates with the blank flip-flop 26, the AND gate 27 and the inverter 34 to prevent generation of a damping pulse until after the printing blade 19 has returned to the backstop from the printing movement initiated by the preceding drive pulse. Thus, the drive circuit 20 effectively prevents the generation of two consecutive damping pulses.

In a constructional model of the preferred embodiment of the invention, the logic circuitry, i.e., all of the circuitry with the exception of the coil driver 21, the amplifiers 24 and 32 and the clock 35 may be formed on a large scale integrated circuit chip.

From the foregoing it can be seen that there has been provided an improved drive circuit for the printing blade of a dot matrix printer, which effectively controls rebound of the printing blade from the backstop, while at the same time modulating the time duration of the drive pulses so as to produce a substantially uniform print intensity with reduced energy consumption and heat dissipation.

What we claim as new and desire to secure by Letters Patent of the United States is:

1. In an impact printer which develops a force whose direction is a function of the direction of drive pulses wherein said printer comprises a movable electromagnetic printing element located adjacent a backstop, a source of drive pulses for application to said printing element for moving the printing element from the backstop toward a record medium to print indicia and a source of damping pulses for application to the printing element after its return to the backstop from the record medium to minimize bounce of the printing element from the backstop, control means coupled to the source of drive pulses and to the source of damping pulses and responsive to the beginning of a drive pulse prior to the completion of the preceding damping pulse for varying the energy content of said drive pulse in proportion to the amount of overlap of said drive pulse with the preceding damping pulse.

2. The improvement of claim 1, wherein said control means varies the time duration of said drive pulse.

3. The improvement of claim 1, wherein said control means decreases the time duration of said drive pulse in direct proportion to the amount of overlap of said drive pulse with the preceding damping pulse.

4. The improvement of claim 1, and further including means for preventing application of a damping pulse to the printing element until after it has impacted on the record medium.

5. The improvement of claim 4, and further including means for preventing application of a damping pulse to the printing element until after the completion of the preceding drive pulse.

6. The improvement of claim 5, and further including means for preventing application of a damping pulse to the printing element until after it is impacted on the backstop.

7. The improvement of claim 1, wherein said control means includes means establishing a predetermined minimum time duration for said drive pulse.

8. The improvement of claim 1, wherein said control means includes means establishing a predetermined maximum time duration for the damping pulses, and further including means responsive to the beginning of a drive pulse for terminating the preceding damping pulse if it has not yet reached said predetermined maximum time duration.

9. In an impact printer which develops a force whose direction is a function of the direction of drive pulses wherein said printer comprises a movable electromagnetic printing element biased toward a backstop, drive means for applying drive pulses to the printing element to move it from the backstop toward a record medium to print indicia and damping means for applying a damping pulse to the printing element after its return to the backstop from the record medium to minimize bounce of the printing element from the backstop, drive timing means for determining the time duration of the drive pulses, damp timing means for determining the time duration of the damping pulses and establishing a standard time duration therefor, and means responsive to the beginning of a drive pulse for terminating the preceding damping pulse if it has not yet reached said standard time duration, said drive timing means including control means coupled to said damp timing means for varying the time duration of each drive pulse in proportion to the time duration of the preceding damping pulse.

10. The improvement of claim 9, wherein said drive timing means includes a counter responsive to the beginning of a drive pulse for terminating said drive pulse after a predetermined count has been reached, said control means varying said predetermined count.

11. The improvement of claim 9, wherein said control means includes logic means.

12. The improvement of claim 9, wherein each drive pulse has a time duration equal to a predetermined minimum time duration plus a predetermined fraction of the time duration of the preceding damping pulse.

13. The improvement of claim 9, wherein said drive timing means includes a counter responsive to the beginning of a drive pulse for terminating said drive pulse after a first predetermined count has been reached, said damp timing means including a counter responsive to the beginning of a damping pulse for terminating said damping pulse after a second predetermined count has been reached, said control means including means responsive to the counting of said second counter for varying said first predetermined count of said first counter.

* * * * *

UNITED STATES PATENT AND TRADEMARK OFFICE

CERTIFICATE OF CORRECTION

PATENT NO. : 4,333,398

DATED : June 8, 1982

INVENTOR(S) : Andrew B. Carson, Jr., et al.

It is certified that error appears in the above-identified patent and that said Letters Patent is hereby corrected as shown below:

Column 5, line 10, "Q" should read -- $\overline{Q}$ --.

Column 5, line 11, "Q" should read -- $\overline{Q}$ --.

Signed and Sealed this

*Third* Day of *August 1982*

[SEAL]

*Attest:*

GERALD J. MOSSINGHOFF

*Attesting Officer*

*Commissioner of Patents and Trademarks*